US006887037B1

(12) United States Patent
Bates

(10) Patent No.: US 6,887,037 B1
(45) Date of Patent: May 3, 2005

(54) BOAT IMPELLER SEAL ASSEMBLY

(76) Inventor: Norris E. Bates, 12504-100th Street, Grande Prairie, Alberta (CA) T8V 4H8

( * ) Notice: Subject to any disclaimer, the term of this patent is extended or adjusted under 35 U.S.C. 154(b) by 25 days.

(21) Appl. No.: 10/356,801

(22) Filed: Feb. 3, 2003

(51) Int. Cl.[7] ..... F04D 29/08
(52) U.S. Cl. ..... 415/173.4; 415/174.4; 415/197; 415/214.1
(58) Field of Search ..... 415/72, 173.4, 415/174.4, 196, 197, 213.1, 214.1

(56) References Cited

U.S. PATENT DOCUMENTS 1,693,352 A * 11/1928 Schmidt ..... 241/101.5
3,249,083 A 5/1966 Irgens
3,951,565 A * 4/1976 Rothe et al. ..... 415/1
4,202,654 A 5/1980 Marlow
4,245,952 A 1/1981 Eberhardt
4,925,408 A 5/1990 Webb et al.
4,973,224 A 11/1990 Pesch
5,346,363 A * 9/1994 Stallman et al. ..... 415/197
D374,710 S 10/1996 Gustafsson
6,062,815 A 5/2000 Holt et al.
6,234,748 B1 5/2001 Brown et al.

* cited by examiner

*Primary Examiner*—Ninh H. Nguyen

(57) ABSTRACT

A boat impeller seal assembly for preventing leakage of debris into the impeller assembly between the impeller housing and the impeller mount. The boat impeller seal assembly includes an impeller assembly including an impeller housing having an open end and also having a bore being disposed therethrough and further having an annular flange being disposed at the open end; and also includes an impeller mount being connected to the impeller housing and having an open end and also having a bore being disposed therethrough and further having an annular flange being disposed at the open end thereof; and further includes a wear seal member being securely and removably disposed in the impeller housing and the impeller mount for preventing debris from entering the impeller housing through the connection between the impeller housing and said impeller mount.

1 Claim, 1 Drawing Sheet

11
12
13
14
15
16
17
18
19
20
21
22
23
24
25
26
3
10

BOAT IMPELLER SEAL ASSEMBLY

BACKGROUND OF THE INVENTION

1. Field of the Invention

The present invention relates to boat impeller sealers and more particularly pertains to a new boat impeller seal assembly for preventing leakage of debris into the impeller assembly between the impeller housing and the impeller mount.

2. Description of the Prior Art

The use of boat impeller sealers is known in the prior art. More specifically, boat impeller sealers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,202,654; U.S. Pat. No. 6,234,748; U.S. Pat. No. 4,925,408; U.S. Pat. No. 3,249,083; U.S. Pat. No. 4,973,224; U.S. Pat. No. 6,062,815; U.S. Pat. No. 4,245,952; and U.S. Pat. No. Des. 374,710.

While these devices fulfill their respective, particular objectives and requirements, the aforementioned patents do not disclose a new boat impeller seal assembly. The prior art includes gaskets and seals being disposed between various connections to prevent leakages.

SUMMARY OF THE INVENTION

The general purpose of the present invention, which will be described subsequently in greater detail, is to provide a new boat impeller seal assembly which has many of the advantages of the boat impeller sealers mentioned heretofore and many novel features that result in a new boat impeller seal assembly which is not anticipated, rendered obvious, suggested, or even implied by any of the prior art boat impeller sealers, either alone or in any combination thereof. The present invention includes an impeller assembly including an impeller housing having an open end and also having a bore being disposed therethrough and further having an annular flange being disposed at the open end; and also includes an impeller mount being connected to the impeller housing and having an open end and also having a bore being disposed therethrough and further having an annular flange being disposed at the open end thereof; and further includes a wear seal member being securely and removably disposed in the impeller housing and the impeller mount for preventing debris from entering the impeller housing through the connection between the impeller housing and said impeller mount. None of the prior art includes the combination of the elements of the present invention.

There has thus been outlined, rather broadly, the more important features of the boat impeller seal assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new boat impeller seal assembly which has many of the advantages of the boat impeller sealers mentioned heretofore and many novel features that result in a new boat impeller seal assembly which is not anticipated, rendered obvious, suggested, or even implied by any of the prior art boat impeller sealers, either alone or in any combination thereof.

Still another object of the present invention is to provide a new boat impeller seal assembly for preventing leakage of debris into the impeller assembly between the impeller housing and the impeller mount.

Still yet another object of the present invention is to provide a new boat impeller seal assembly that is easy and convenient to set up and use.

Even still another object of the present invention is to provide a new boat impeller seal assembly that increases the performance of the impeller by preventing any leakage through the connection.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3:
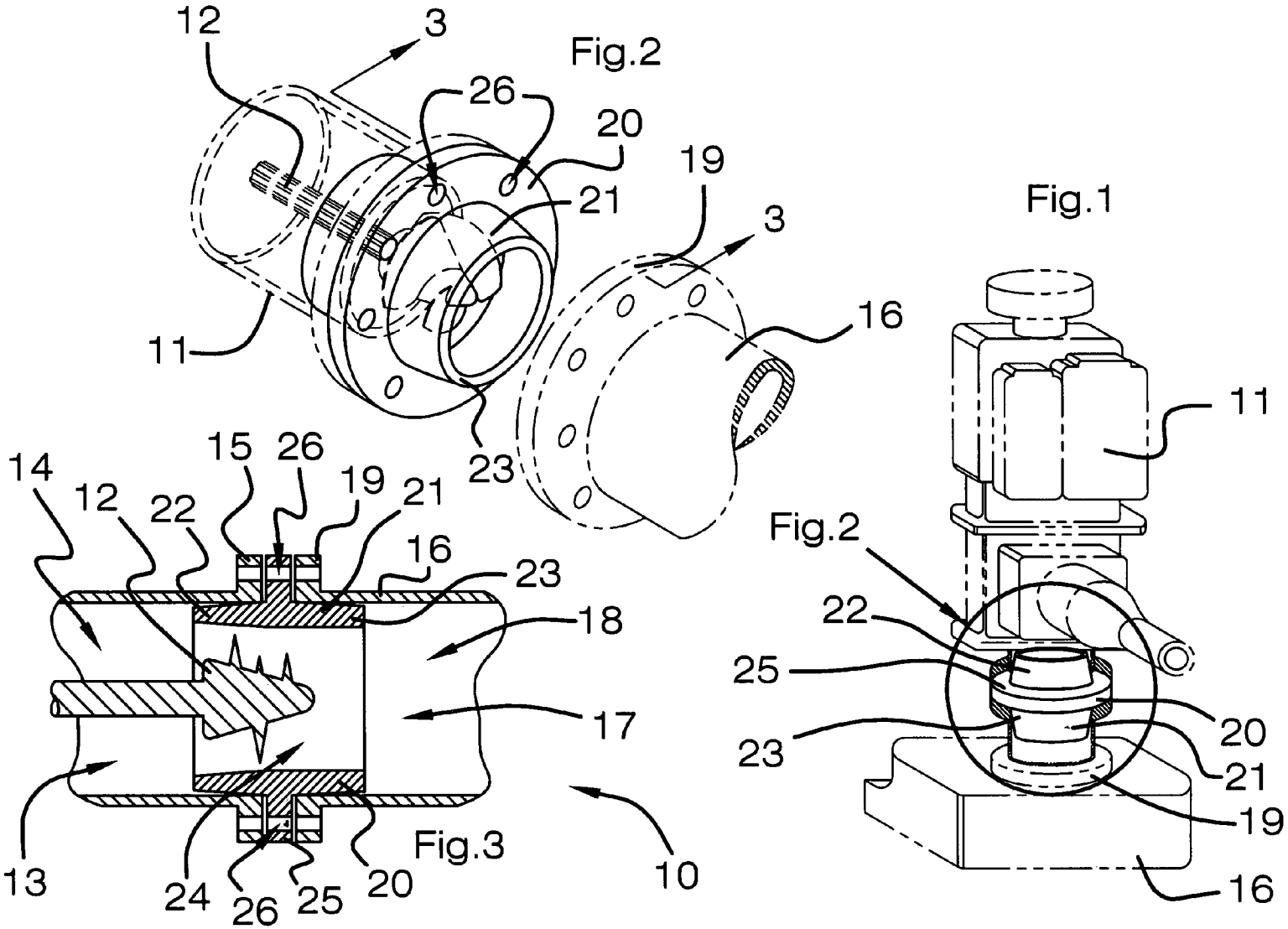
FIG. 1 is a perspective view of a new boat impeller seal assembly according to the present invention.
FIG. 2 is an exploded perspective view of the present invention.
FIG. 3 is a cross-sectional view of the present invention.

With reference now to the drawings, and in particular to FIGS. 1 through 3 thereof, a new boat impeller seal assembly embodying the principles and concepts of the present invention and generally designated by the reference numeral 10 will be described.

As best illustrated in FIGS. 1 through 3, the boat impeller seal assembly 10 generally comprises an impeller assembly including an impeller housing 11 having an open end 13 and also having a bore 14 being disposed therethrough and further having an annular flange 15 having holes being spacedly disposed therethrough, and being conventionally disposed at the open end 13, and also including an impeller 12 being disposed in said bore 14 of said impeller housing 11.

An impeller mount 16 is fastenably connected to the impeller housing 11 and has an open end 17 and also having a bore 18 being disposed therethrough and further having an annular flange 19 having holes being spacedly disposed therethrough, and being conventionally disposed at the open end 17 thereof.

A wear seal member 20 is securely and removably disposed in the impeller housing 11 and the impeller mount 16 for preventing debris from entering the impeller assembly through the connection between the impeller housing 11 and the impeller mount 16. The wear seal member 20 includes a tubular portion 21 having a first end portion 22 being engageably disposed in the bore 14 through the open end 13 of the impeller housing 11 and also having a second end portion 23 being engageably disposed in the bore 18 through the open end 17 of the impeller mount 16. The tubular portion 21 further has a bore 24 extending therethrough. The bore 24 through the tubular portion 21 is tapered from the first end portion 22 to the second end portion 23 thereof. The wear seal member 20 also includes an annular collar portion 25 being exteriorly and integrally disposed about a midsection of the tubular portion 21 and being fastenably engaged between the annular flanges 15,19 of the impeller housing 11 and the impeller mount 16. The wear seal member 20 further includes a plurality of holes 26 being circumferentially-spaced and disposed through the annular collar portion 25 and being adapted to receive fasteners for fastening the annular collar portion 25 between the annular flanges 15,19 of the impeller housing 11 and the impeller mount 16. The wear seal member 20 is made of a durable plastic material with a wall of the tubular portion 21 being pressed against walls forming the bores 14,18 of the impeller housing 11 and the impeller mount 16.

In use, the wear seal member 20 prevents debris from leaking into the impeller assembly, in particular, and causing damage to the impeller 12, but also allows water t be forced from the impeller 12 to propel the boat upon the water.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the boat impeller seal assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boat impeller seal assembly comprising:

an impeller assembly including an impeller housing having an open end and also having a bore being disposed therethrough and further having an annular flange being disposed at said open end;

an impeller mount being connected to said impeller housing and having an open end and also having a bore being disposed therethrough and further having an annular flange being disposed at said open end thereof;

a wear seal member being securely and removably disposed in said impeller housing and said impeller mount for preventing debris from entering said impeller assembly through the connection between said impeller housing and said impeller mount, said wear seal member including a tubular portion having a first end portion being engageably disposed in said bore through said open end of said impeller housing and also having a second end portion being engageably disposed in said bore through said open end of said impeller mount, said tubular portion further having a bore extending therethrough, said wear seal member also including an annular collar portion being exteriorly disposed about a midsection of said tubular portion and being fastenably engaged between said annular flanges of said impeller housing and said impeller mount, said wear seal member further including a plurality of holes being circumferentially-spaced and disposed through said annular collar portion and being adapted to receive fasteners for fastening said annular collar portion between said annular flanges of said impeller housing and said impeller mount, said bore through said tubular portion is tapered from said first end portion to said second end portion thereof for fittingly supporting an impeller, said wear seal member being made of a durable plastic material with a wall of said tubular portion being pressed against walls forming said bores of said impeller housing and said impeller mount.

* * * * *